US008221104B2

(12) United States Patent
Wilson et al.

(10) Patent No.: US 8,221,104 B2
(45) Date of Patent: Jul. 17, 2012

(54) SCREW COMPRESSOR HAVING A SLIDE VALVE WITH HOT GAS BYPASS PORT

(75) Inventors: Francis P. Wilson, Jamesville, NY (US); Stephen L. Shoulders, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 964 days.

(21) Appl. No.: 12/279,565

(22) PCT Filed: Mar. 13, 2006

(86) PCT No.: PCT/US2006/009374

§ 371 (c)(1),
(2), (4) Date: Aug. 15, 2008

(87) PCT Pub. No.: WO2007/106090

PCT Pub. Date: Sep. 20, 2007

(65) Prior Publication Data

US 2010/0272580 A1 Oct. 28, 2010

(51) Int. Cl.
*F01C 1/00* (2006.01)
*F01C 1/24* (2006.01)
*F04B 39/00* (2006.01)

(52) U.S. Cl. ..... 418/201.2; 417/310

(58) Field of Classification Search ..... 417/310, 417/309, 307; 418/159, 201.2
See application file for complete search history.

(56) References Cited

U.S. PATENT DOCUMENTS 3,088,659 A * 5/1963 Nilsson et al. ..... 418/159
3,527,548 A * 9/1970 Grant et al. ..... 417/310
3,656,876 A * 4/1972 Kocher ..... 418/185
3,885,402 A 5/1975 Moody, Jr. et al.
4,074,957 A * 2/1978 Clarke et al. ..... 418/195
4,234,296 A * 11/1980 Matsubara et al. ..... 418/201.2
4,388,048 A 6/1983 Shaw et al.
4,575,323 A * 3/1986 Yoshimura ..... 418/201.2
4,597,726 A * 7/1986 Soderlund et al. ..... 418/201.2
5,018,948 A 5/1991 Sjtöholm et al.

(Continued)

FOREIGN PATENT DOCUMENTS

DE 10326466 1/2005

(Continued)

OTHER PUBLICATIONS

International Search Report mailed on Aug. 29, 2006.

(Continued)

*Primary Examiner* — Devon C Kramer
*Assistant Examiner* — Nathan Zollinger
(74) *Attorney, Agent, or Firm* — Carlson, Gaskey & Olds, P.C.

(57) ABSTRACT

A compressor includes a slide valve (24) having a passage that can be in fluid communication with a discharge plenum (22) and a suction plenum (20). The slide valve (24) position may be axially adjusted to control an amount of refrigerant that is compressed between a male rotor (14) and a female rotor (12) in the compressor based upon a system control scheme that determines capacity demand. The passage (28) is in fluid communication with the discharge plenum (22) and the suction plenum (20) when the slide valve is in a fully unloaded position or a partially unloaded position. A compressor housing blocks an opening to the passage when the slide valve (24) is in a fully loaded position. The location of the opening (36) in the slide valve determines what point in axial travel of the slide valve that fluid bypass begins.

17 Claims, 3 Drawing Sheets

U.S. PATENT DOCUMENTS

| | | | | |
|---|---|---|---|---|
| 5,203,685 | A * | 4/1993 | Andersen et al. | 418/1 |
| 6,135,744 | A * | 10/2000 | Andersen et al. | 418/201.2 |
| 6,302,668 | B1 * | 10/2001 | Lee | 418/201.2 |
| 2011/0038747 | A1 * | 2/2011 | Shoulders | 418/201.2 |

FOREIGN PATENT DOCUMENTS

| | | |
|---|---|---|
| GB | 1370100 | 10/1974 |
| JP | 60138295 | 7/1985 |

OTHER PUBLICATIONS

International Preliminary Report on Patentability mailed on Sep. 25, 2008.

Extended European Search Report dated Nov. 15, 2011 for EP Application No. 06738437.0.

* cited by examiner

SCREW COMPRESSOR HAVING A SLIDE VALVE WITH HOT GAS BYPASS PORT

This application is a United States National Phase application of PCT Application No. PCT/US2006/009374 filed Mar. 13, 2006.

BACKGROUND OF THE INVENTION

This invention relates to a compressor including a slide valve with a hot gas bypass incorporated in the slide valve.

Compressors and the vapor compression systems in which they are installed must be able to operate at their full capacity and at some reduced capacity, depending on the application and environmental surroundings (i.e. the outdoor temperature, temperature of media being cooled, and volume/flow rate of the media being cooled). It is desirable to have a compressor/system that can continuously operate at the smallest possible percentage of full load capacity to avoid on/off cycling of the compressor/system and to avoid the temperatures swings in the media being cooled that will result from the on/off cycling.

As a result of the need to operate at less than full load capacity at certain times, compressors must have a method of varying the amount of refrigerant that they compress. Screw compressors, in many cases, use slide valves as their unloading mechanism. As the slide valve moves toward the discharge end of the compressor, the compressor's displacement or swept volume decreases, which in turn reduces the amount of refrigerant that the compressor draws in, compresses and discharges. It is desirable to have a screw compressor achieve the lowest possible percent of full load while minimizing the amount the slide valve has to travel toward the discharge end of the compressor Screw compressors may also use "lift" or "poppet" valves, suction throttling, or hot gas bypass, internally or externally applied, to achieve partially unloaded or unloaded operation. Hot gas bypass, in particular, vents refrigerant (that has already been compressed) from the discharge plenum or discharge line back to the suction plenum thereby displacing some of the refrigerant that would have otherwise entered the compressor through the suction flange. The bypass line(s) requires a solenoid valve to control the unloading through the bypass line. All of these methods lower the amount of refrigerant circulating through the vapor compression system with varying amounts of efficiency. If any of these methods are used in conjunction with a slide valve to further reduce the amount by which the compressor unloads, they will require additional compressor/system controls. Therefore, there is a need in the art for a slide valve that allows for greater unloading of the compressor but does not require increasing length or size of the compressor or additional unloading controls.

SUMMARY OF THE INVENTION

The present invention provides a compressor including a slide valve and a passage located within the slide valve that can be in fluid communication with a discharge plenum and a suction plenum of the compressor.

A compressor used in a vapor compression system includes a housing having a male rotor and a female rotor located in a chamber of the housing. The compressor includes a suction port, which communicates the suction plenum to the cavity volume and a discharge port, which communicates the discharge plenum to the cavity volume. Refrigerant enters the chamber at a suction pressure from the suction plenum and is compressed between the male rotor and female rotor. The refrigerant exits the chamber and flows into the discharge plenum at a discharge pressure.

A slide valve is located adjacent the male rotor and the female rotor. The slide valve position may be axially adjusted to control the amount of refrigerant that is drawn in and compressed in the compressor. A passage located within the slide valve is in fluid communication with the suction plenum and the discharge plenum when the slide valve is in a fully unloaded position or a near fully unloaded position. The passage has an axial portion that extends through the slide valve parallel to an axis along which the slide valve travels. The passage also includes a radial portion extending from the axial portion to a sidewall of the slide valve forming an opening. The housing blocks the opening when the slide valve is in a fully loaded or part loaded position and becomes unblocked at the fully unloaded position.

As the environment in which the compressor/vapor compression system operates changes, the required capacity of the compressor changes. For example, as the condensing temperature decreases, the system and hence the compressor does not need to operate at full capacity to remove the heat from media being cooled. When the condensing temperature decreases, a control moves the slide valve from the fully loaded position toward the fully unloaded position based on the temperature that is desired in the media being cooled. At a predetermined position in the axial travel of the slide valve, the opening to the passage is no longer blocked by the compressor housing. At this point, the compressed refrigerant travels through the passage from the high pressure area near the discharge plenum to the low pressure area of the chamber near the suction plenum. The location of the opening in the slide valve determines what point in the axial travel of the slide valve that fluid bypass begins.

The displacement volume of the compressor (or cavity volume at it initial state) will be its smallest when the slide valve is in the fully unloaded position. The passage is in fluid communication with both the suction plenum and the discharge plenum. The housing no longer blocks the opening, allowing refrigerant from the discharge plenum to flow through the passage to the suction plenum. By reducing the displacement volume to the smallest volume possible and bypassing a portion of the refrigerant that has been compressed back to the suction plenum, the amount of compressed refrigerant that exits the compressor decreases; thereby reducing system capacity. The decrease in capacity prevents the compressor from having to cycle between operating and non-operating modes when the environmental conditions exist such that reduced amounts of refrigerant are required by the evaporator to achieve the desired heat transfer from the media being cooled.

When the slide valve is in the position where the passage opening is partially blocked by the housing and partially open to the discharge plenum, the shape of the opening controls the amount of refrigerant that enters into the passage. As a result, no additional mechanisms are needed to control unloading.

These and other features of the present invention can be best understood from the following specification and drawings, the following of which is a brief description.

DETAILED DESCRIPTION OF THE PREFERRED EMBODIMENT

Figure 1:
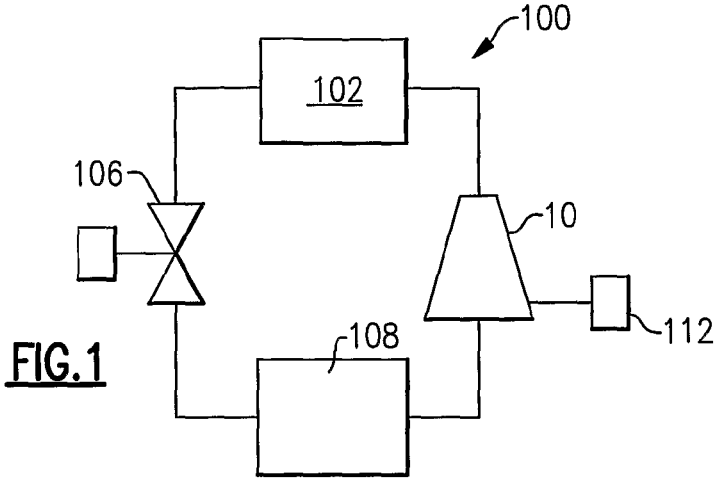
FIG. 1 is a schematic view of a vapor compression system of the present invention.

FIG. 1 illustrates a vapor compression system 100, such as an air conditioning system, including a compressor 10 that compresses a fluid, such as refrigerant, and delivers the refrigerant downstream to a condenser 102. In the condenser 102, the refrigerant rejects heat to an external fluid medium, such as air or water. The refrigerant travels to an expansion device 106 and is expanded to a low pressure. The refrigerant accepts heat from another fluid medium in an evaporator 108. The refrigerant then flows to the compressor 10, completing the cycle.

A capacity control mechanism 112 is positioned connected to the compressor 10. The capacity control mechanism 112 controls the location of a slide valve 24 within the compressor 10. The capacity control mechanism 112 adjusts a piston attached to the slide valve 24 to control a position of the slide valve 24.

Figure 2:
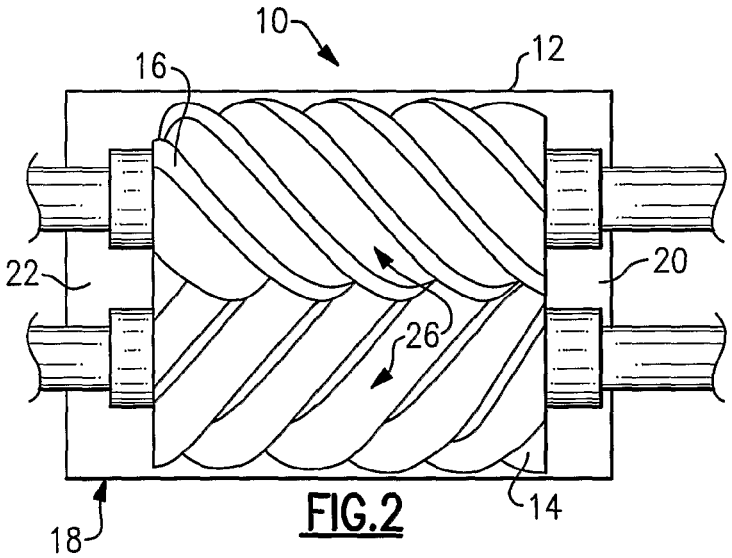
FIG. 2 is side view of a compressor of the present invention.

FIG. 2 illustrates the compressor 10. In one embodiment, the compressor 10 is a twin-screw type compressor. However, other types of screw compressors (mono screw and tri-screw) may benefit from the invention. A male rotor 14 and a female rotor 16 in meshed engagement are located in a chamber 18 in a housing 12. The compressor 10 includes a suction plenum 20 and a discharge plenum 22. Refrigerant enters the chamber 18 at a suction pressure from the suction plenum 20. The refrigerant passes between the male rotor 14 and the female rotor 16, where it is compressed within a compression chamber (cavity volume) 26. The refrigerant exits the chamber 18 and flows into the discharge plenum 22 at a discharge pressure.

Figure 3:
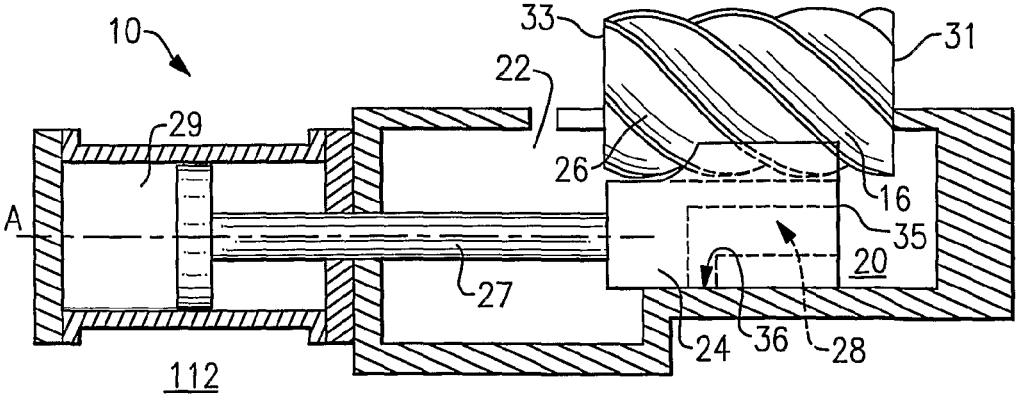
FIG. 3 is a schematic illustration of a slide valve of the present invention in the compressor.

FIG. 3 shows the slide valve 24 located adjacent the female rotor 16 and the male rotor 14 (located behind female rotor 16 in FIG. 3). The position of slide valve 24 may be axially adjusted along an axis A by the capacity control mechanism 112 to adjust a volume of a compression chamber 26 and to control the amount of refrigerant that is compressed between the male rotor 14 and the female rotor 16. That is, the slide valve 24 may decrease the displacement volume of the compression chamber 26 between the male rotor 14 and the female rotor 16 to reduce the amount of refrigerant being compressed. Alternately, the slide valve 24 may increase the volume of the compression chamber 26 (shown in FIG. 2) to increase the amount of refrigerant being compressed. In this manner, the slide valve 24 may vary the amount of refrigerant that is compressed.

A piston 27 attached to the slide valve 24 controls the position of the slide valve 24. The capacity control mechanism 112 regulates a location of the piston 27. The capacity control mechanism 112 regulates the position of the piston 27 by increasing or decreasing pressure within a piston chamber 29. The piston 27 is moved axially along the axis A as the pressure within the piston chamber 29 is adjusted. The piston 27 is connected to the slide valve 24. As the position of the piston 27 is adjusted, the position of the slide valve 24 is accordingly adjusted as well.

The possible volume of the compression chamber 26 begins at the suction end 31 of the male rotor 14 and female rotor 16 and continues to the discharge end 33 of the male rotor 14 and female rotor 16. Thus, a position of an end 35 of the slide valve 24 determines where along the length of the male rotor 14 and female rotor 16 compression begins. For example, when the slide valve 24 is positioned to be as close as possible to the suction plenum 20, and the compression chamber 26 begins at the suction end 31 to provide the maximum the displacement volume of the compression chamber 26. This is called a fully loaded position and provides the largest amount of compressed refrigerant leaving the compressor 10. Correspondingly, when the slide valve 24 travels axially toward the discharge plenum 22, the end 35 of the slide valve 24 moves away from the suction end 31 of the male rotor 14 and female rotor 16, the cavity volume begins to decrease in size, providing a partially loaded position. When the slide valve 24 reaches the end of travel and is positioned to be as close as possible to the discharge plenum, the displacement volume of the compression chamber 26 is at the minimum volume. This is called a fully unloaded position and provides the lowest amount of compressed refrigerant leaving the compressor 10.

In addition to controlling the size of the displacement volume of the compression chamber 26, the slide valve 24, when in some positions, unloads refrigerant from the discharge plenum 22 to the suction plenum 20 through a passage 28, or hot gas bypass port. The passage 28 allows the slide valve 24 to further vary the amount of compressed refrigerant that exits the compressor 10 by returning a portion of the refrigerant to the suction plenum 20. Due to the location of the passage 28 within the slide valve 24, no further controls are required to achieve the additional unloading. By decreasing the displacement volume of the compressor 10 down to its smallest possible and practical amount and by-passing some of the compressed refrigerant back to the suction plenum from the discharge plenum, the amount of compression provided by the compressor 10 decreases and allows the compressor 10 to run continuously, even when the system requirements for refrigerant flow are low. This provides a more efficient vapor compression system 100 than one where the compressor 10 cycles through running and stationary modes.

Figure 4:
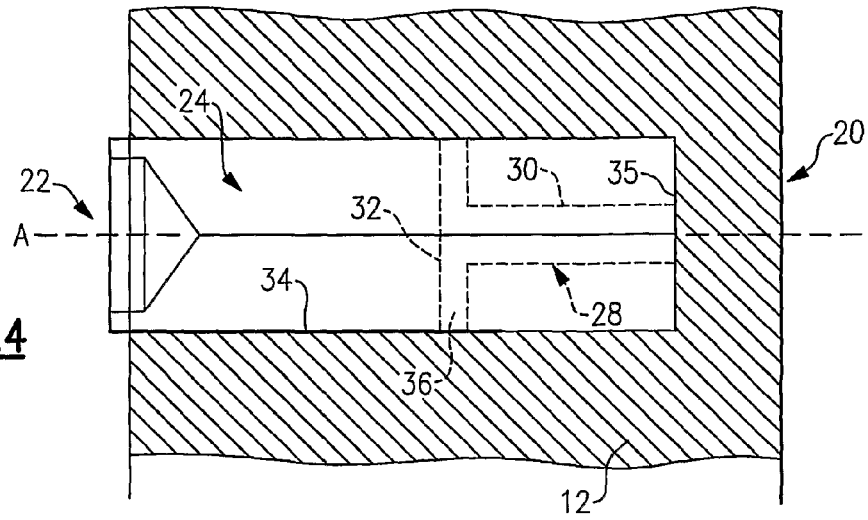
FIG. 4 is a schematic illustration of a slide valve of the present invention in the fully loaded position.

FIG. 4 schematically illustrates the slide valve 24 of the present invention in the fully loaded position as described above. The fully loaded position corresponds to the position of the slide valve 24 that is closest to the suction plenum 20 and provides the largest displacement volume of the compressor 10. The largest displacement volume of the compressor 10 corresponds to the greatest amount of compressed refrigerant leaving the compressor 10. This position is desired when the compressor/system must deliver the maximum capacity. A passage 28 is located within the slide valve 24. In the embodiment shown, the passage 28 has an axial portion 30 that extends through the slide valve 24 parallel to the axis A along which the slide valve 24 travels. A radial portion 32 extends from the axial portion 30 to at least one sidewall 34 of the slide valve 24, forming an opening 36. In the fully loaded position of the slide valve 24, the housing 12 blocks the opening 36, preventing refrigerant communication between the suction plenum 20 and the discharge plenum 22.

When the slide valve 24 is in the fully loaded position described above, the passage 28 is blocked to avoid the inefficiencies associated with venting already compressed vapor back to the suction plenum. As the need for system capacity diminishes, less compressor displacement volume is required. The capacity control mechanism 112 adjusts the position of the slide valve 24 accordingly. The slide valve 24 is adjusted toward the fully unloaded position. By decreasing the displacement volume of the compression chamber 26 and allowing fluid communication between the discharge plenum 22 and the suction plenum 20 through the passage 28, compressor 10 and hence system capacity decreases.

Figure 5:
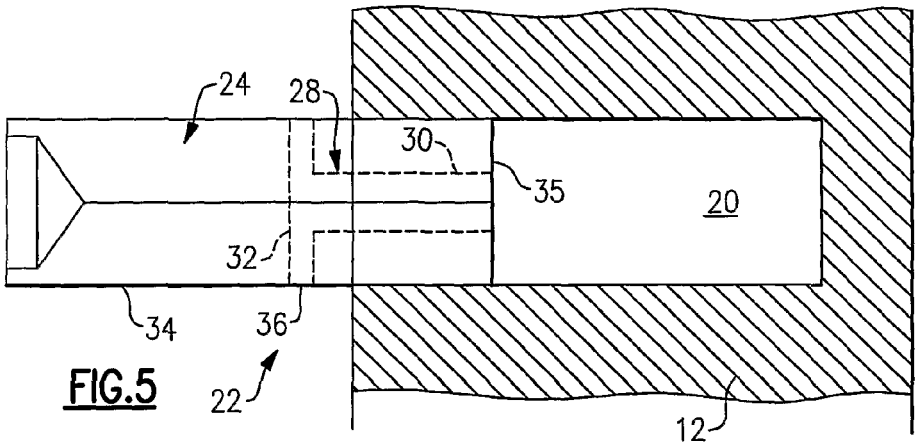
FIG. 5 is a schematic illustration of a slide valve of the present invention in the fully unloaded position.

FIG. 5 illustrates the slide valve 24 in the fully unloaded position, described above. The fully unloaded position corresponds to the slide valve 24 position that is as close as possible to the discharge plenum and provides the lowest volume of refrigerant that is compressed. The initial state of compression chamber 26 is at its smallest volume when the slide valve 24 is in the fully unloaded position. This position is desired when there is a need for the smallest compressor/system capacity. Because it is desired to have the compressor 10 operate at only a portion of full capacity, rather than not at all, the amount of compressed refrigerant leaving the compressor 10 is reduced as much as possible.

In the fully unloaded position, the passage 28 is in fluid communication with both the suction plenum 20 and the discharge plenum 22. The housing 12 no longer blocks the opening 36 in the sidewall 34, allowing the compressed refrigerant from the discharge plenum 22 to flow through the passage 28 to the suction plenum 20 due to lower pressure in the suction plenum 20. By reducing the displacement volume of the compression chamber 26 to the smallest volume possible and bypassing a portion of the refrigerant that has been compressed back to the suction plenum 20, the amount of compressed refrigerant that exits the compressor 10 decreases. Thus, the capacity of the compressor 10 is decreased, allowing the compressor 10 to run continuously to prevent cycling between a running mode and stationary mode.

Figure 6:
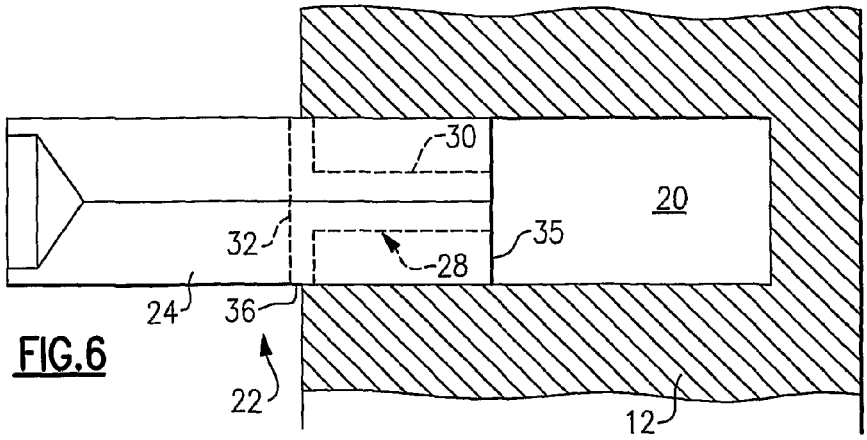
FIG. 6 is a schematic illustration of a slide valve of the present invention in the partially loaded position.

FIG. 6 shows the slide valve 24 in a partially loaded position that is between the fully loaded position and the fully unloaded position. As the environment being cooled changes, the required capacity of the compressor 10 changes. For example, as the outdoor environment temperature decreases, the refrigerant temperature and the pressure within condenser 102 decreases. The compressor 10 does not need to work at the same capacity level to achieve the desired temperature in evaporator 108 within the system 100. When the environment temperature decreases, the slide valve 24 begins to move from the fully loaded position toward the fully unloaded position to decrease the amount of compressed refrigerant leaving the compressor 10. At a predetermined position in the axial travel of the slide valve 24, the opening 36 reaches a point where it is no longer blocked by the housing 12. At this point, the compressed refrigerant travels from the high pressure discharge plenum 22 connected through the passage 28 to the low pressure suction plenum 20. The axial location of the opening 36 in the slide valve 24 determines at what point in the axial travel of the slide valve 24 that fluid bypass begins. One skilled in the art would know the desired axial location for additional refrigerant unloading based upon the parameters of the compressor application. As the environment being cooled in the vapor compression system 100 varies, the amount of capacity required will vary as well. The capacity control mechanism 112 adjusts the position of the slide valve 24 between the fully loaded position and the fully unloaded position accordingly. Thus, the position of the slide valve 24 is continuously changing.

Figure 7A:
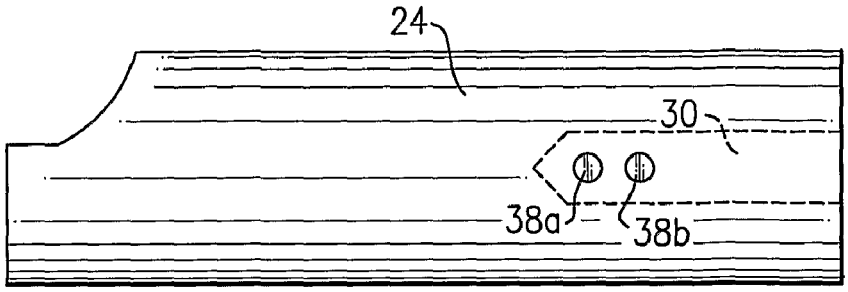
FIG. 7*a* is an illustration of one embodiment of the opening in the slide valve of the present invention.
Figure 7B:
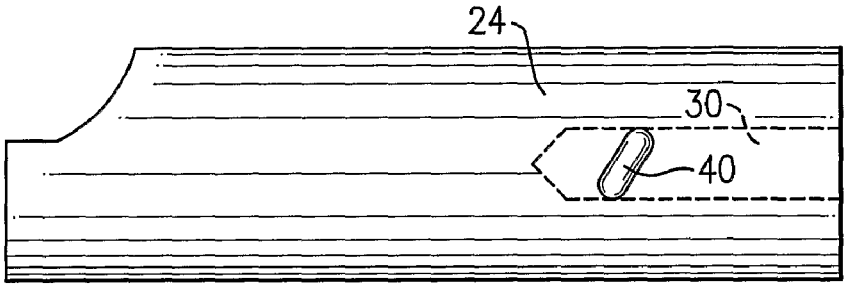
FIG. 7*b* is an illustration of a second embodiment of the opening in the slide valve of the present invention.
Figure 7C:
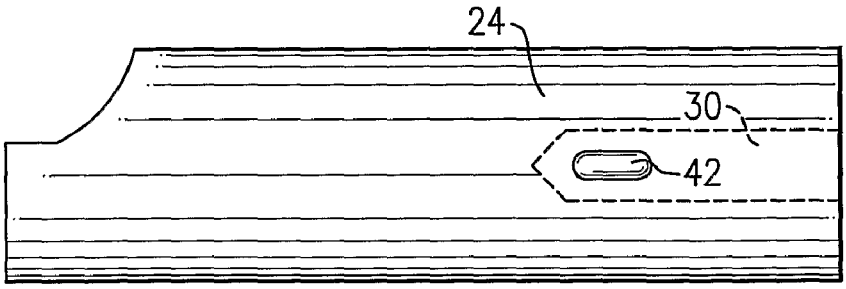
FIG. 7*c* is an illustration of a third embodiment of the opening in the slide valve of the present invention.
Figure 7D:
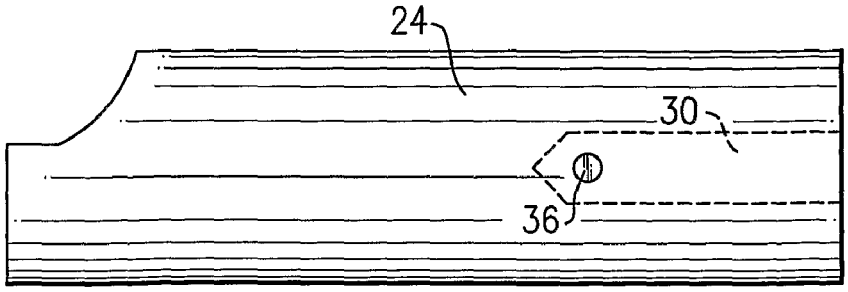
FIG. 7*d* is an illustration of the fourth embodiment of the opening in the slide valve of the present invention.

FIGS. 7*a*, 7*b* and 7*c* and 7*d* illustrate several embodiments of the slide valve 24 and the opening 36. When the slide valve 24 is in the partially loaded position where the opening 36 is partially blocked by the housing 12 and partially open to the discharge plenum 22, as in FIG. 6, the shape of the opening 36 controls the amount of refrigerant that enters into the passage 28. In FIG. 7*a*, the opening is actually a plurality of holes 38*a* and 38*b*. When the slide valve 24 is in the position shown in FIG. 6, one of the holes 38*b* may be blocked by the housing 12, while the other hole 38*a* is exposed to the discharge plenum 22. In FIG. 7*b*, the opening 40 is shown on an angle compared to the axial portion 30 of the passage 28. The shape of opening 40 allows the amount of refrigerant entering the passage 28 to increase over the travel of the slide valve 24. Likewise, FIG. 7*c* shows an oblong opening 42 that is parallel to the axial portion 30 of the passage 28. The oblong opening 42 will require more travel to expose the full opening 42 to the discharge plenum 22 than the amount of travel needed to expose the opening 40. FIG. 7*d* illustrates the opening 36 described in the first embodiment above. Opening 36 provides a single hole connecting to the axial portion 30 of the passage 28.

Although several embodiments are shown, other shapes and positions for the opening 36 may be utilized. One skilled in the art would know the desired shape and location of the opening 36 for each compressor application.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor comprising:

a housing including a chamber in fluid communication with a suction plenum and a discharge plenum;

a pair of rotors located in said chamber in meshing engagement with one another to compress a fluid from a suction pressure at said suction plenum to a discharge pressure at said discharge plenum; and a slide valve adjacent said pair of rotors including a passage having an axial portion that extends at least partially along an axial length of said slide valve, a first radial portion that extends between said axial portion and a sidewall of said slide valve to define a first opening in said sidewall, and a second radial portion that extends between said axial portion and an opposing sidewall of said slide valve to define a second opening in said opposing sidewall, wherein said passage is blocked by said housing to prevent fluid communication between said discharge plenum and said suction plenum along said passage when said slide valve is in a fully loaded position within said housing to prevent said fluid from flowing from said discharge plenum to said suction plenum, and wherein the first radial portion and the second radial portion are in fluid communication with each other, the first opening and the first radial portion having a same cross-sectional area, and the second opening and the second radial portion having a same cross-sectional area.

2. A compressor comprising:

a housing including a chamber in fluid communication with a suction plenum and a discharge plenum;

a pair of rotors located in said chamber in meshing engagement with one another to compress a fluid from a suction pressure at said suction plenum to a discharge pressure at said discharge plenum; and a slide valve adjacent said pair of rotors including a passage having an axial portion that extends at least partially along an axial length of said slide valve, a first radial portion that extends between said axial portion and a sidewall of said slide valve to define a first opening in said sidewall, and a second radial portion that extends between said axial portion and an opposing sidewall of said slide valve to define a second opening in said opposing sidewall, wherein said axial portion extends from a suction end of said slide valve, wherein said passage is in fluid communication with said discharge plenum when said slide valve is in a partially unloaded position within said housing, and said first opening and said second opening are partially exposed to said discharge plenum to allow said fluid to flow from said discharge plenum to said suction plenum, and wherein the first radial portion and the second radial portion are in fluid communication with each other, the first opening and the first radial portion having a same cross-sectional area, and the second opening and the second radial portion having a same cross-sectional area.

3. A compressor comprising:

a housing including a chamber in fluid communication with a suction plenum and a discharge plenum;

a pair of rotors located in said chamber in meshing engagement with one another to compress a fluid from a suction pressure at said suction plenum to a discharge pressure at said discharge plenum; and a slide valve adjacent said pair of rotors including a passage including a sidewall, an axial portion that extends partially along an axial length of said slide valve, a first radial portion that extends between said axial portion and said sidewall of said slide valve to define a first opening in said sidewall, and a second radial portion that extends between said axial portion and an opposing sidewall of said slide valve to define a second opening in said opposing sidewall, wherein the first radial portion and the second radial portion are in fluid communication with each other, the first opening and the first radial portion having a same cross-sectional area, and the second opening and the second radial portion having a same cross-sectional area, wherein said passage allows said fluid to flow from said discharge plenum to said suction plenum along said passage when said slide valve is in one of a fully unloaded position and a partially unloaded position, and said passage is blocked by said housing to prevent said fluid from flowing from said discharge plenum to said suction plenum along said passage when said slide valve is in a fully loaded position.

4. The compressor of claim 3, wherein said fully unloaded position corresponds to said first opening and said second opening being fully exposed to said discharge plenum to allow said fluid to flow from said discharge plenum to said suction plenum along said passage.

5. The compressor of claim 3, wherein said fully loaded position corresponds to said first opening and said second opening being blocked by said compressor housing to prevent said fluid from flowing from said discharge plenum to said suction plenum along said passage.

6. The compressor of claim 3, wherein a control mechanism is connected to said slide valve, wherein a position of said slide valve within said housing is controlled by said control mechanism.

7. A method of controlling capacity of a compressor comprising the steps of:

compressing a fluid from a suction pressure at a suction plenum to a discharge pressure at a discharge plenum using a pair of rotors of the compressor; and selectively delivering a portion of the fluid from the discharge plenum to the suction plenum through a passage in a slide valve adjacent the pair of rotors to control capacity of said compressor, wherein said passage includes an axial portion that extends at least partially along an axial length of said slide valve, a first radial portion that extends between said axial portion and a sidewall of said slide valve to define a first opening in said sidewall, and a second radial portion that extends between said axial portion and an opposing sidewall of said slide valve to define a second opening in said opposing sidewall, wherein the first radial portion and the second radial portion are in fluid communication with each other, the first opening and the first radial portion having a same cross-sectional area, and the second opening and the second radial portion having a same cross-sectional area, and wherein said step of selectively delivering includes adjusting a location of the slide valve to block the passage in the slide valve with a housing to prevent fluid communication through the passage between the discharge plenum and the suction plenum.

8. The method of claim 7, wherein said step of selectively delivering includes adjusting a location of the slide valve to position the first opening and the second opening defined by the first radial portion and the second radial portion, respectively, of the passage in fluid communication with the discharge plenum to allow the fluid to flow from the discharge plenum to the suction plenum.

9. The compressor of claim 3 wherein the first radial portion and the second radial portion are aligned to define a straight line.

10. The compressor of claim 3 wherein the first opening and the second opening are substantially circular.

11. The compressor of claim 3 wherein the first opening and the second opening are substantially oblong, and a longitudinal axis of the first opening and the second opening is parallel with respect to an axis of the slide valve.

12. The compressor of claim 3 wherein the first opening and the second opening are substantially oblong, and a longitudinal axis of the first opening and the second opening is at an angle with respect to an axis of the slide valve.

13. The method of claim 7 wherein the first radial portion and the second radial portion are aligned to define a straight line.

14. The method of claim 7 wherein the first opening and the second opening are substantially circular.

15. The method of claim 7 wherein the first opening and the second opening are substantially oblong, and a longitudinal axis of the first opening and the second opening is parallel with respect to an axis of the slide valve.

16. A compressor comprising:

a housing including a chamber in fluid communication with a suction plenum and a discharge plenum., a pair of rotors located in said chamber in meshing engagement with one another to compress a fluid from a suction pressure at said suction plenum to a discharge pressure at said discharge plenum; and a slide valve adjacent said pair of rotors including a passage having an axial portion that extends at least partially along an axial length of said slide valve, a first radial portion that extends between said axial portion and a sidewall of said slide valve to define a first opening in said sidewall, and a second radial portion that extends between said axial portion and an opposing sidewall of said slide valve to define a second opening in said opposing sidewall, wherein the first radial portion and the second radial portion are in fluid communication with each other, the first opening and the first radial portion having a same cross-sectional area, and the second opening and the second radial portion having a same cross-sectional area, and wherein the first opening and the second opening are substantially oblong, and a longitudinal axis of the first opening and the second opening is at an angle with respect to an axis of the slide valve.

17. A method of controlling capacity of a compressor comprising the steps of:

compressing a fluid from a suction pressure at a suction plenum to a discharge pressure at a discharge plenum using a pair of rotors of the compressor; and selectively delivering a portion of the fluid from the discharge plenum to the suction plenum through a passage in a slide valve adjacent the pair of rotors to control capacity of said compressor, wherein said passage includes an axial portion that extends at least partially along an axial length of said slide valve, a first radial portion that extends between said axial portion and a sidewall of said slide valve to define a first opening in said sidewall, and a second radial portion that extends between said axial portion and an opposing sidewall of said slide valve to define a second opening in said opposing sidewall, wherein the first radial portion and the second radial portion are in fluid communication with each other, the first opening and the first radial portion having a same cross-sectional area and the second opening and the second radial portion having a same cross-sectional area, wherein the first opening and the second opening are substantially oblong, and a longitudinal axis of the first opening and the second opening is at an angle with respect to an axis of the slide valve.

* * * * *